US006460308B1

(12) United States Patent
Armstrong et al.

(10) Patent No.: US 6,460,308 B1
(45) Date of Patent: Oct. 8, 2002

(54) FOUNDATION BOLT REWORK KIT AND METHOD OF USING SAME

(76) Inventors: John Armstrong, 2519 Fisk La., Redondo Beach, CA (US) 90278; George Velasco, 2107 Pullman La., Apt. B, Redondo Beach, CA (US) 90278

( * ) Notice: Subject to any disclaimer, the term of this patent is extended or adjusted under 35 U.S.C. 154(b) by 0 days.

(21) Appl. No.: 09/775,777

(22) Filed: Feb. 5, 2001

(51) Int. Cl.[7] ..... E04B 1/38

(52) U.S. Cl. ..... 52/698; 52/293.3; 52/295; 52/514; 52/741.1

(58) Field of Search ..... 52/293.3, 295, 52/514, 745.09

(56) References Cited

U.S. PATENT DOCUMENTS

| | | | | |
|---|---|---|---|---|
| 1,429,263 A | | 9/1922 | Wolfe | |
| 2,625,815 A | * | 1/1953 | Black | 52/293.3 |
| 2,632,355 A | | 3/1953 | Becker | 85/32 |
| 2,881,876 A | * | 6/1959 | Williams | 52/293.3 |
| 3,305,987 A | | 2/1967 | Weaver | 52/283 |
| 3,618,992 A | | 11/1971 | Whistler, Sr. | 287/20.92 E |
| 3,829,540 A | * | 8/1974 | Cox | 52/295 |
| 4,033,243 A | | 7/1977 | Kirrish et al. | 85/4 |
| 4,108,043 A | | 8/1978 | Varga | 85/70 |
| 4,117,643 A | | 10/1978 | Lamothe | 52/669 |
| 4,312,145 A | | 1/1982 | Lukavich | 37/124 |
| 4,376,332 A | | 3/1983 | Sandefur | 29/402.08 |
| 4,872,298 A | | 10/1989 | Klemic, Jr. | 52/127.1 |
| 5,085,547 A | | 2/1992 | Vanotti | 411/72 |
| 5,163,775 A | | 11/1992 | Rowan, Jr. | 403/301 |
| 5,249,404 A | | 10/1993 | Leek et al. | 52/702 |
| 5,393,165 A | | 2/1995 | Rowan, Jr. | 403/301 |
| 5,428,936 A | | 7/1995 | Roth | 52/704 |
| 5,542,777 A | | 8/1996 | Johnson | 403/389 |
| 5,890,332 A | | 4/1999 | Skidmore et al. | 52/271 |
| 6,006,487 A | | 12/1999 | Leek | 52/698 |

* cited by examiner

*Primary Examiner*—Carl D. Friedman
(74) *Attorney, Agent, or Firm*—Cislo & Thomas LLP

(57) ABSTRACT

A kit for reworking an improperly installed concrete foundation bolt protruding an insufficient distance above a wood frame structure sill plate includes a combination nut-sleeve having a continuous internal thread, and an elongate cap sized to cover the foundation bolt. The cap is placed over the external threads of the foundation bolt, and a conventional hole saw used to remove material surrounding the foundation bolt. The cap is removed and the nut-sleeve combination installed. The length of engagement of the foundation bolt external thread is effectively increased, solving the problem of the improperly installed bolt in an easy and cost-effective manner.

6 Claims, 3 Drawing Sheets

FOUNDATION BOLT REWORK KIT AND METHOD OF USING SAME

BACKGROUND OF THE INVENTION

1. Field of the Invention

This invention relates generally to problems with anchor bolts, and more particularly to reworking an improperly installed foundation bolt such that it extends a sufficient distance above attaching wood frame structure to meet local building codes.

2. Description of the Related Art

In home construction in California and other earthquake-prone areas, most local building codes require a large number of foundation bolts to tie the wood frame structure to the foundation. Since earthquakes introduce side loads into wood frame structures, the foundation bolts are needed to help prevent the house from moving off the foundation. Hurricanes pose similar threats and dictate the use of foundation bolts in the southeastern United States.

The foundation bolts are set every few feet into the concrete foundation before it hardens, and the wood frame structure is added. For a ⅝ inch diameter foundation bolt, the threaded end must extend at least ⅝ inch above the wood frame. If the foundation bolt fails to extend a sufficient distance, conventional practice is to drill into the concrete and properly install another foundation bolt, a labor-intensive task. Accordingly, a better way of dealing with an improperly installed foundation bolt is needed.

Others in the prior art have made certain related efforts to repair damaged anchor bolts or to utilize anchor bolts in new ways including in building construction, and the development of specialty hardware associated therewith, but those solutions have been less than satisfactory and appear generally inapplicable to the problem at hand. For example, Rowan Jr. U.S. Pat. No. 5,393,165 disclosed a bulky anchor bolt repair coupling held on by set screws or other engaging means. Klemic Jr. U.S. Pat. No. 4,872,298 disclosed various devices extending from an anchor bolt set in concrete. Weaver, U.S. Pat. No. 3,305,987 disclosed a nut device threaded onto a projecting bolt, and having a load bearing portion that fits into grooves in a ledger beam. Becker, U.S. Pat. No. 2,632,355 disclosed flanged nut hardware to engage a bolt disposed in a hole in a panel. Finally, Skidmore et, al. U.S. Pat. No. 5,890,332 disclosed a simple threaded sleeve for use with an anchor bolt to a steel rod.

SUMMARY OF THE INVENTION

The present invention addresses the problem at hand in a way not found or suggested in the prior art. Recall that an improperly installed foundation bolt is one having external threads protruding an insufficient distance above surrounding wood frame material for proper engagement of a conventional nut. A kit for reworking such foundation bolts includes a combination nut-sleeve having a continuous internal thread sized to engage the external thread of the foundation bolt. Further included is an elongate cap sized to cover the protruding external thread of the foundation bolt. The improper installation is reworked by covering the protruding foundation bolt with the cap, removing the material surrounding the foundation bolt with a conventional hole saw, and installing the threaded nut-sleeve combination onto the foundation bolt.

Preferably the length of the cap is slightly less than the internal length of the conventional hole saw, so as to maximize protection of the foundation bolt external threads as the surrounding material is removed at greater depths. The upper end of the cap preferably includes a transverse hole for facilitating removal of the cap from the foundation. A conventional hole saw sized to remove wood frame material from around the foundation bolt, and a conventional plate washer having a hole sized to accept the outside diameter of the elongate sleeve may also be included in the rework kit, although such materials would usually be available at most construction sites.

The method for reworking an improperly installed foundation bolt involves the placing a cap over the foundation bolt to protect the screw thread from damage, using a conventional hole saw to remove material surrounding the screw thread, removing the cap, and installing a combination threaded sleeve-nut onto the foundation bolt. The result is the length of possible engagement of the foundation bolt has been effectively extended, and the installation of the nut satisfactorily completed. The method also preferably includes installing a conventional plate washer onto the foundation bolt, prior to installing the combination threaded sleeve-nut.

OBJECTS OF THE INVENTION

It is an object of the present invention to provide a kit for reworking improperly installed foundation bolts, rather than having to install replacements.

It is a further object of the present invention to provide a method for reworking improperly installed foundation bolts, saving time and money over conventional methods.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
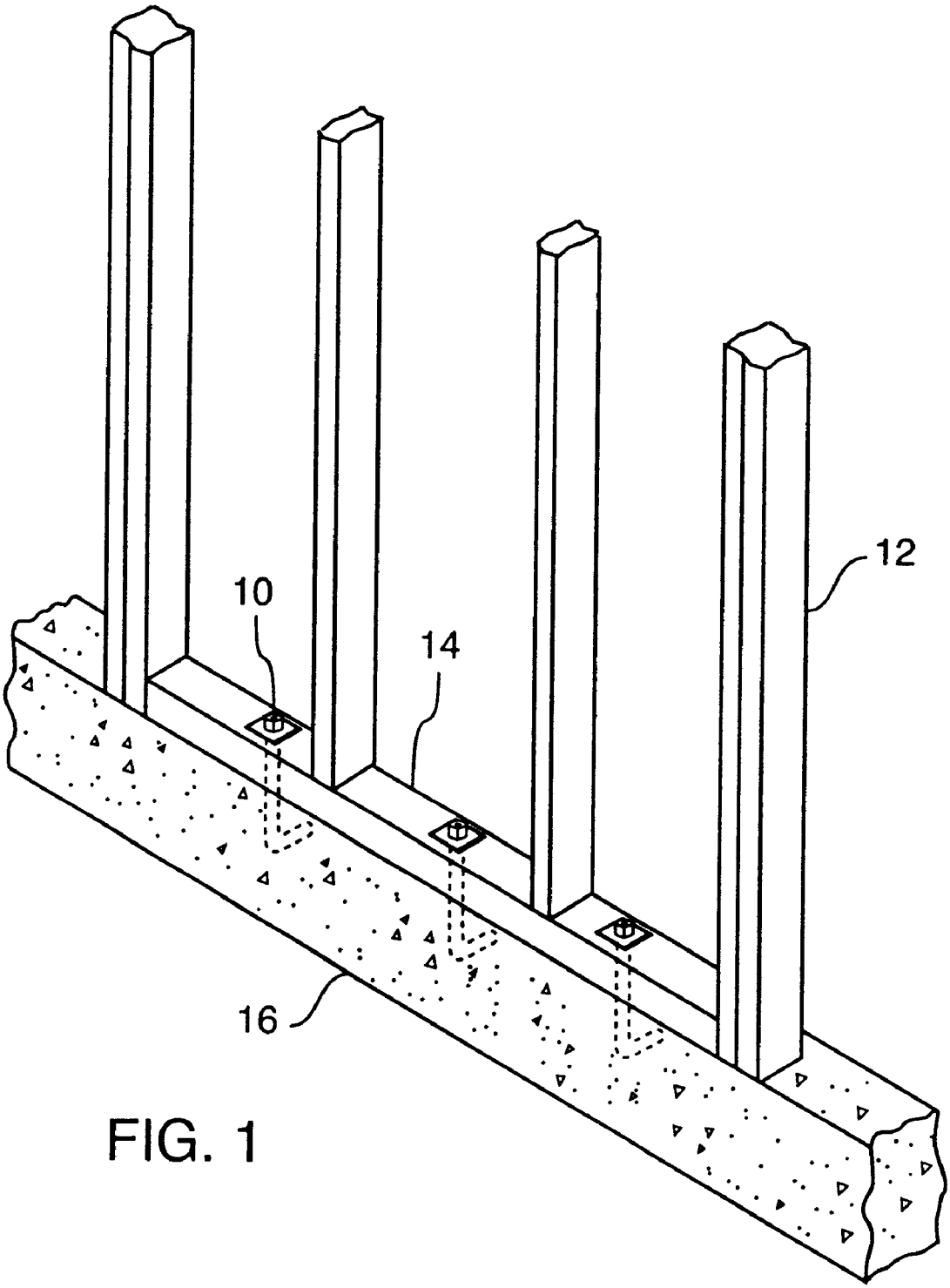
FIG. 1 is a perspective view of several foundation bolts installed on a wood frame structure.

Referring to FIG. 1, shown are several foundation bolts 10 installed on a wood frame structure 12 as typically found in new residential home construction in California. In particular, the foundation bolts 10 secure the sill plate 14 to the underlying concrete surface 16. The foundation bolts 10 are generally spaced apart a maximum of 6 feet, although a foundation bolt must be found within one foot of the end of any wall. Additionally, on sheer walls which are carrying higher loads, a foundation bolt 10 may be required as close as every six inches. Accordingly, in an average-sized 1,800-square foot house there may easily be over 100 foundation bolts 10.

The foundation bolts 10 are generally laid out prior to pouring of the foundation, and then removed when the foundation is poured. Before the concrete 16 is fully cured the foundation bolts 10 are pushed in. Invariably, several of the foundation bolts 10 are pushed too far into the concrete 16. The sill plates 14 are added, and those improperly installed foundation bolts 10 fail to protrude a sufficient distance above the sill plate 14, thereby precluding proper installation of a conventional nut (not shown) on the foundation bolt 10. For example, a ⅝ inch diameter foundation bolt 10 is improperly installed if less than ⅝ inch of it protrudes above the sill plate 14. Normal practice is a new hole must be drilled in the concrete surface 14 and another foundation bolt 10 installed, a labor-intensive task.

Figure 2:
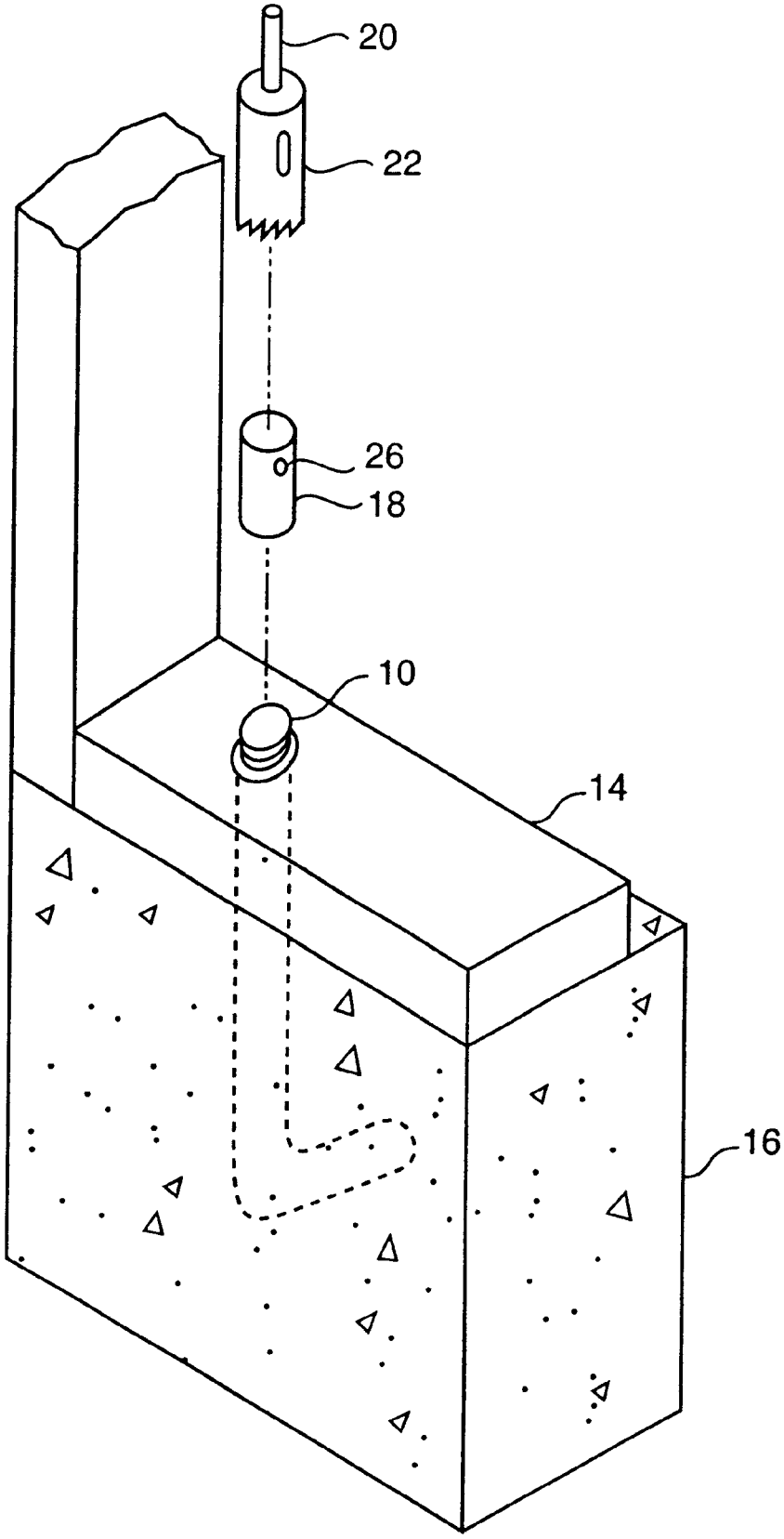
FIG. 2 is an exploded perspective view showing use of parts of a kit to rework an improperly installed foundation bolt.

Next referring to FIG. 2, elements of a kit for use in reworking an improperly installed foundation bolt 10 are shown, including a cap 18 and conventional hole saw 20. The conventional hole saw 20 has a cylindrical-shaped body portion 22 including an internal cavity and saw teeth at one end. The length of the cap 18 is preferably slightly less than the length of the internal cavity of the hole saw 20, for reasons which will become clear. The cap 18 also preferably includes a through hole 26, again for reasons which will become clear.

Figure 3:
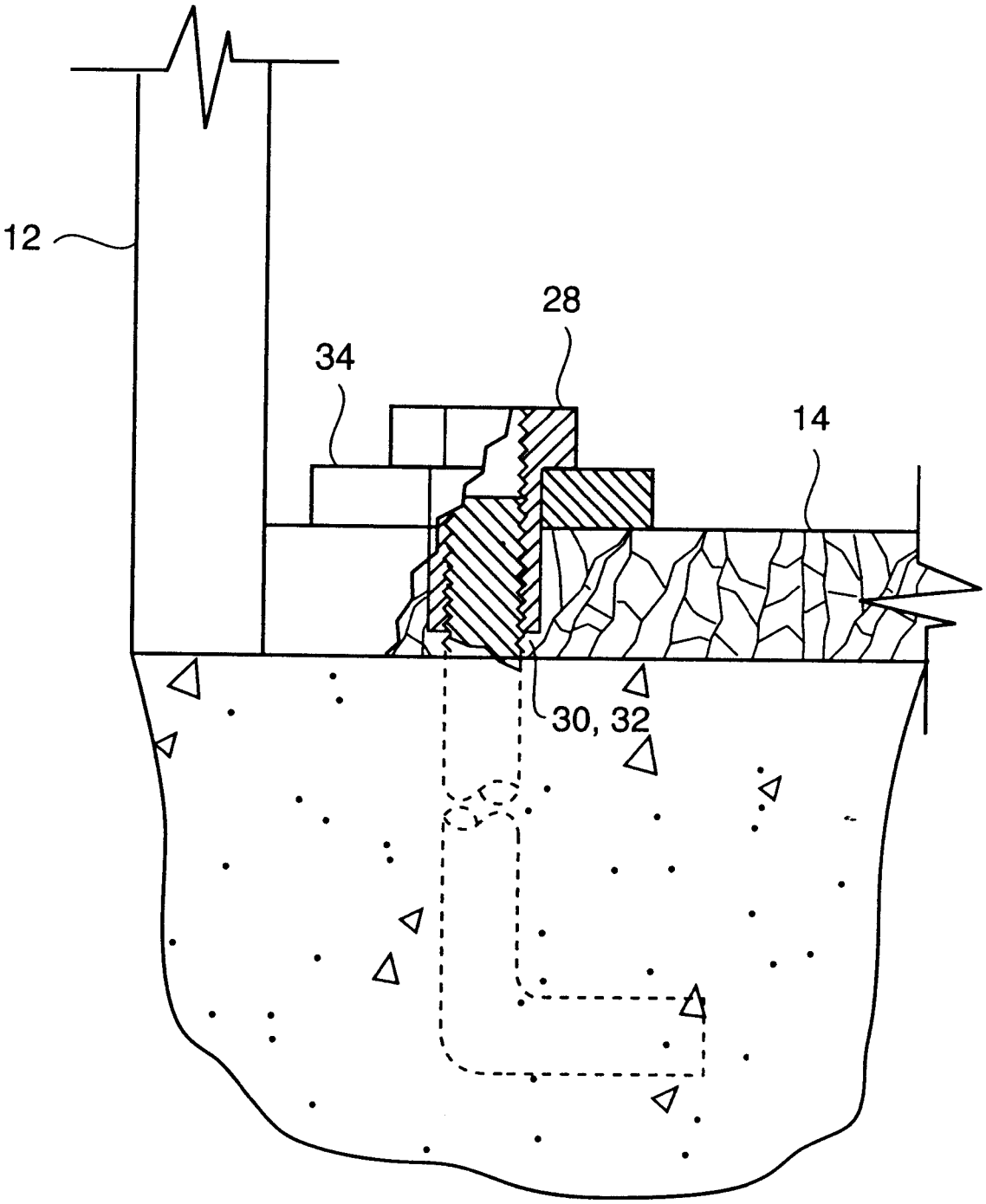
FIG. 3 is a FIG. 3 is a side elevational view of a reworked foundation bolt including a nut/sleeve combination as part of the installation.

Now referring to FIG. 3, other parts of the rework kit as installed are shown. A combination nut-sleeve 28 includes a continuous internal thread 30 sized to engage an external thread 32 of the foundation bolt 10. The nut-sleeve 28 is machined from a single piece of hardened steel. Also shown is a conventional plate washer 34.

The rework kit is used as follows. Foundation bolts 10 set too far into the concrete surface 16 are identified. A cap 18 is installed over the protruding foundation bolt 10. A conventional hole saw 20 is used to remove material from the sill plate 14 around the cap 18 and foundation bolt 10. The internal cavity of the hole saw 20 preferably slightly longer than the cap 18 allows for removal of material while protecting the external threads 30 of the foundation bolt 10. When the material removal operation is completed, the hole saw 20 and cap 18 are removed.

Next the conventional plate washer 34 is installed over the foundation bolt 10, and then the combination nut-sleeve 28 is installed, its continuous internal thread 30 engaged with the external thread 32 of the foundation bolt 10. The effective length of the foundation bolt 10 which is engaged by the nut-sleeve 28 is increased, to greater than what was possible through use of a conventional nut (not shown) on an improperly installed foundation bolt 10.

While the present invention has been described with regards to particular embodiments, it is recognized that additional variations of the present invention may be devised without departing from the inventive concept. By way of example only, the present invention may be applied to hold-down bolts which secure walls to the foundation by way of fittings.

What is claimed is:

1. A kit for reworking an improperly installed foundation bolt having an external thread protruding an insufficient distance above surrounding wood frame material for proper engagement of a conventional nut, the kit comprising:

a combination nut-sleeve having a sleeve portion and a nut portion, and having a continuous internal thread therethrough, the internal thread sized to engage the external thread of the foundation bolt; and, an elongate cap sized to cover the external thread of the foundation bolt;

whereby the improperly installed foundation bolt may be reworked by covering the external thread with the elongate cap, removing the wood frame material surrounding the foundation bolt with a conventional hole saw, and installing the combination nut-sleeve onto the foundation bolt.

2. The kit of claim 1 wherein the upper end of the elongate cap includes a transverse hole to facilitate removal of the cap from the foundation bolt.

3. The kit of claim 1 further comprising:

a conventional hole saw sized to remove the wood frame material from around the foundation bolt.

4. The kit of claim 3 further comprising a conventional washer having a hole sized greater than the outside diameter of the sleeve portion of the combination nut-sleeve but less than the outside diameter of the nut portion of the combination nut-sleeve.

5. A method for reworking an improperly installed foundation bolt having a screw thread extending an insufficient distance above surrounding wood frame material to satisfactorily install a nut, the steps comprising:

placing a cap over the foundation bolt to protect the screw thread from damage;

using a conventional hole saw to remove the wood frame material surrounding the screw thread;

removing the cap; and, installing a threaded sleeve-nut combination onto the foundation bolt;

whereby, the length of possible engagement of the foundation bolt has been effectively extended and the installation of the nut satisfactorily completed.

6. The method of claim 5 further comprising the additional step of:

installing a washer onto the foundation bolt prior to installing the threaded sleeve-nut combination.

* * * * *